US006033152A

United States Patent [19]

Blum

[11] Patent Number: 6,033,152

[45] Date of Patent: Mar. 7, 2000

[54] PILE FORMING APPARATUS

[75] Inventor: Kenneth J. Blum, Parkville, Mo.

[73] Assignee: Berkel & Company Contractors, Inc., Bonner Springs, Kans.

[21] Appl. No.: 09/045,403

[22] Filed: Mar. 20, 1998

Related U.S. Application Data

[63] Continuation-in-part of application No. 08/954,768, Oct. 20, 1997, abandoned, which is a continuation-in-part of application No. 08/840,107, Apr. 11, 1997, abandoned.

[51] Int. Cl.[7] ..... E02D 11/00; E21B 7/28

[52] U.S. Cl. ..... 405/241; 175/325.3; 405/242; 405/271

[58] Field of Search ..... 405/233, 240–242, 405/253, 254, 271; 175/325.3, 394, 408

[56] References Cited

U.S. PATENT DOCUMENTS

| | | | |
|---|---|---|---|
| 1,139,529 | 5/1915 | Hughes | 175/227 |
| 1,248,614 | 12/1917 | Chapman | 175/349 |
| 1,322,540 | 11/1919 | Chapman | 175/334 |
| 3,255,592 | 6/1966 | Moor | 405/238 |
| 3,282,055 | 11/1966 | Landau | 405/271 |
| 3,926,267 | 12/1975 | Svirschevsky et al. | 175/19 |
| 4,193,461 | 3/1980 | Lamberton et al. | 175/19 |
| 4,230,191 | 10/1980 | Svirschevsky et al. | 175/20 |
| 4,433,943 | 2/1984 | Pao Chen | 405/241 |
| 4,504,173 | 3/1985 | Feklin | 405/240 |
| 5,722,498 | 3/1998 | Van Impe et al. | 405/241 X |

*Primary Examiner*—David Bagnell
*Assistant Examiner*—Tara L. Mayo
*Attorney, Agent, or Firm*—Hovey, Williams, Timmons & Collins

[57] ABSTRACT

An improved lateral soil displacement and compaction auger (24) is provided including a central shaft (34) equipped with a central cementious material pipe (42), helical flighting sections (36,38) and lower rollers (64A–64E) positioned between lower flight sections. The rollers (64A–64E) are strategically located so that their outer peripheries cooperatively define an expanding spiral from the lower end of the auger (24) towards the central section (50) thereof. The rollers (64A–64E) are primarily responsible for lateral soil displacement and compaction during rotation of the auger (24) and do so with reduced frictional buildup. The preferred auger (24) also includes a lower cap (40) which is retained during auger rotation by teeth (90,92); during filling operations, the cap (40) is shifted downwardly to allow ejection of cementious material from the pipe (42) while retaining the cap (40). Downhole pressure buildup during filling can be monitored and adjusted through use of a pressure gauge (108) and throttle valve (110). In an alternative embodiment, an auger (132, 134) is equipped with an upper, lateral soil displacement and compaction portion (136) together with a lower drilling extension (138). Alternately, a auger monitoring and control assembly (182) is used, made up of series-coupled cementious material flow and cementious material pressure sensors (186, 188), together with an auger depth sensor (190). The sensors (186–190) are coupled to a readout device (200).

24 Claims, 5 Drawing Sheets

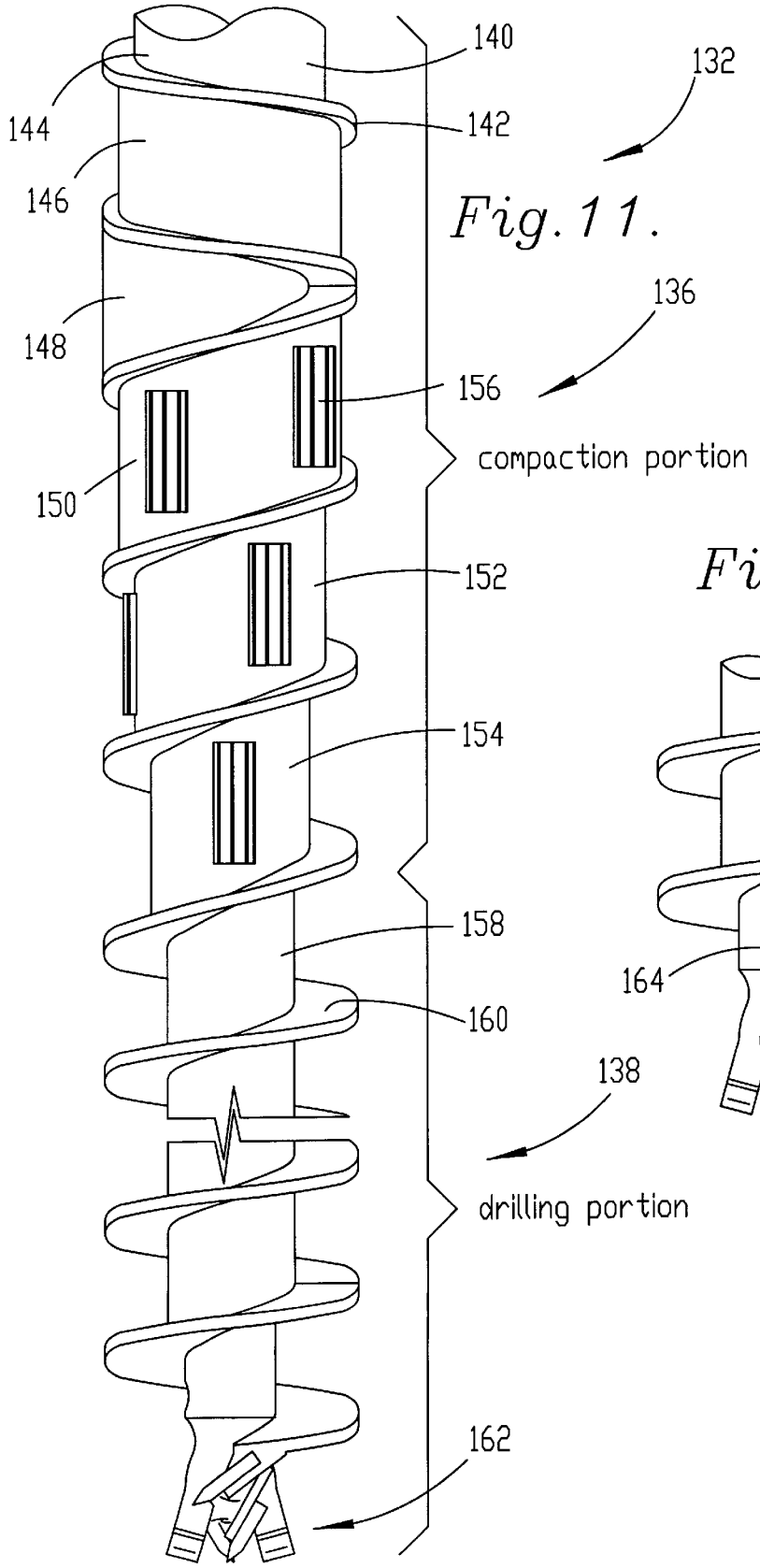
Fig. 11.
Fig. 12.
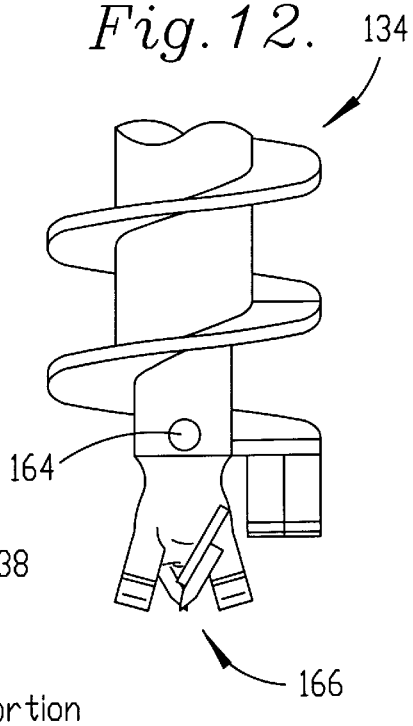

PILE FORMING APPARATUS

RELATED APPLICATION

This continuation-in-part of application Ser. No. 08/954,768 filed Oct. 20, 1997, now abandoned, which is a continuation-in-part of application Ser. No. 08/840,107 filed Apr. 11, 1997, now abandoned.

BACKGROUND OF THE INVENTION

1. Field of the Invention

The present invention is broadly concerned with a lateral soil compaction auger designed for use in the formation of bore holes without generating undue amounts of spoil. The preferred auger includes, along the lower extent thereof, strategically spaced compaction rollers mounted within the auger shaft and operable to laterally displace and compact soil during bore hole formation. The preferred auger also includes a lower end cap mounted for rotation with the auger but having retention structure assuring that the cap is not lost during withdrawal of the auger from the bore hole. Additionally, the preferred auger assembly of the invention is equipped with control apparatus such as cementious material (e.g., grout or cement) pressure and flow monitoring and adjusting structure, and drill depth sensing means allowing the user to precisely control formation of bore holes and filling thereof. The augers of the invention may advantageously be equipped with an elongated drilling extension section below the lateral compaction portion thereof, allowing the augers to drill into high density soils below a softer area subject to lateral compaction.

2. Description of the Prior Art

Structural piles are commonly formed through the use of auger pressure grouting techniques. In such operations, an upright support cage or frame is positioned adjacent a pile site and an auger assembly is mounted to the frame including an elongated, flighted auger having a hollow central shaft. During pile-forming operations, the auger is shifted downwardly and rotated so as to screw into the earth. When the auger reaches a desired depth, it is withdrawn and grout or other cementious material is directed under pressure through the central auger shaft to create the pile. These conventional operations create substantial amounts of "spoil", meaning the displaced earth created by the auger and conveyed upwardly to grade. This spoil must be removed and this represents a considerable expense.

Soil displacement augers have been proposed in the past which substantially reduce or eliminate the spoil problem. In such augers, the shaft and flighting is designed so as to laterally displace the soil during bore hole formation and to compact the soil at the periphery of the bore hole. Most lateral displacement augers employ an expanding spiral configuration to displace and compact the earth. This expanding spiral configuration generates great friction, requiring high torque drilling rigs with pull-down capabilities up to 12,000 pounds. Even with high torque and pull-down capabilities, drilling depth with conventional lateral soil displacement augers is greatly reduced.

It also occurs during pile formation that undue pressure is developed as an adjunct to filling. If such pressures are generated, the cementious material can be caused to rapidly set, thus effectively entrapping the auger bit and causing its loss. This of course represents a very significant expense to the construction company, and is to be avoided at all costs.

SUMMARY OF THE INVENTION

The present invention overcomes the problems outlined above, and provides an improved lateral soil displacement and compaction auger used in the formation of bore holes adapted to receive cementious material for pile formation. The compaction augers of the invention include an elongated central shaft together with outwardly extending helical auger flighting supported thereon, with the shaft and flighting being cooperatively configured for lateral displacement and compaction of soil during rotation of the auger. Such lateral displacement and compaction is facilitated through the use of a plurality of strategically located elongated rollers each presenting an outer periphery and designed to displace and compact soil during auger rotation. Each of these rollers is mounted between respective flight sections of the auger flighting through use of an elongated, arcuate in cross-section casing member coupled with the shaft and complemental with the rollers received therein. In order to avoid buildup of earth on the rollers and thus diminish their effectiveness, the clearances between roller periphery and the adjacent casing is relatively small. The preferred rollers used in the augers of the invention include a plurality of elongated, circumferentially spaced, outwardly projecting peripheral ribs; these ribs reduce frictional forces encountered during bore hole formation.

The central auger shaft preferably includes an innermost, hollow, cementious material-conveying pipe, together with an outer shaft body presenting a central region of maximum diameter which defines the diameter of the bore hole to be created by the auger, with the shaft being of decreasing diameter from the central region toward both the upper and lower ends of the auger.

The lowermost end of the auger is equipped with an end cap, the latter being retained in place by spaced apart ears or teeth secured to the auger and engaging projecting portions of the end cap. Thus, during rotation of the auger, the end cap is driven along with the auger proper. However, during filling operations, the end cap is shifted axially downwardly so as to permit passage of cementious material from the central cementious material pipe. The end cap retaining teeth are sized so as to permit such axial opening movement of the end cap while still maintaining engagement with the cap. As a further means of assuring end cap retention, internal chains are provided which are coupled to the cementious material pipe and end cap.

The overall auger assembly of the invention also includes means such as a cementious material pump for supplying cementious material to the central cementious material pipe of the auger with cementious material delivery and return lines operatively coupled between the pump and the auger. In addition, pressure within the cementious material return line is monitored by an appropriate gauge or the like, and throttle valve means is provided for selective adjustment of this pressure. In this way, the operator can be assured that if undue pressures are generated during filling, this condition can be reduced by appropriate throttle valve manipulation.

In an alternative embodiment of the invention, an auger is provided having an upper section for lateral soil displacement and compaction, together with a lower, elongated extension below the compaction portion. The extension preferably has a substantially constant diameter central shaft together with helical flighting, the latter advantageously being of constant pitch. In preferred forms, the extension has a length at least 50% of the length of the compaction portion, and is even more preferably of a length at least equal to that of the compaction portion. Any one of a number of cutting leads may be supported on the lower end of the extension, and the extension is also equipped with a cementious material passageway through the sidewalls thereof. Use of this embodiment has proven to be helpful in bore hole formation in soils having relatively loose compactible soil zones with lower, higher density soils. Thus, a bore hole of adequate length can be provided with lateral displacement and compaction only in upper, relatively loose soil zones.

In a further embodiment, the auger of the invention is equipped with a cementious material flow sensor and cementious material pressure sensor in series with the cementious material supply line, as well as a drill depth sensor. In this way, the operation of the auger can be precisely controlled.

BRIEF DESCRIPTION OF THE DRAWINGS

FIG. 11 is a fragmentary side view illustrating another auger in accordance with the invention having an upper lateral soil displacement and compaction portion together with a lower drilling extension;

FIG. 12 is a fragmentary side view of an auger of the type depicted in FIG. 11, but illustrating the use of another type of cutting head supported at the lower end of the drilling extension;

DETAILED DESCRIPTION OF THE DRAWINGS

Figure 1:
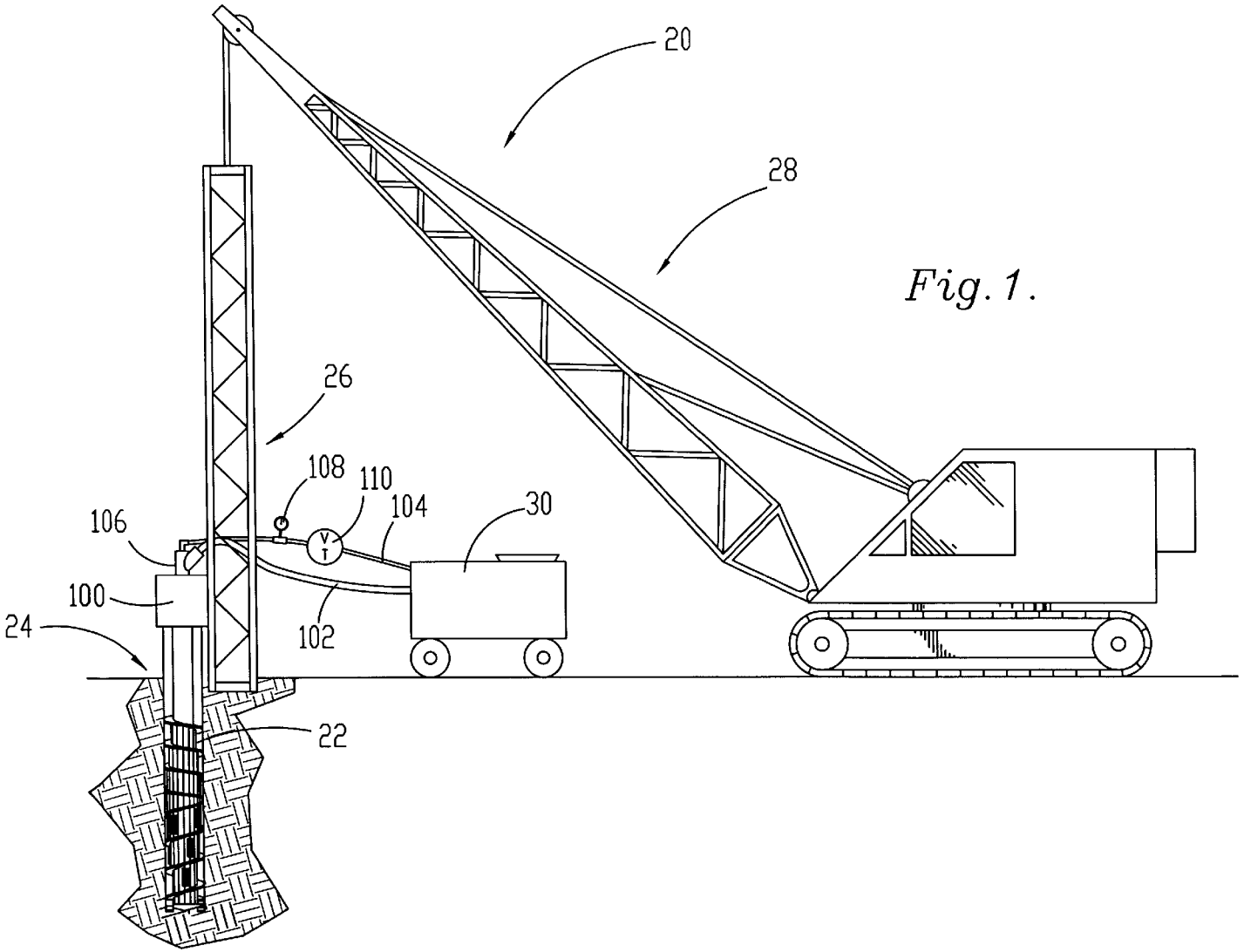
FIG. 1 is a schematic view illustrating a preferred pile-forming assembly in accordance with the invention, including a lateral soil displacement and compaction auger operatively coupled with a cementious material pump and pressure relief structure.

Turning now to the drawings and particularly FIG. 1, a lateral compaction auger assembly 20 designed for the formation of bore holes 22 with a minimum of spoil is illustrated. The assembly 20 broadly includes a lateral compaction auger bit 24 supported on an upright cage 26, the latter held in place via a conventional mobile crane 28. The overall assembly 10 further includes a cementious material pump 30 operatively coupled to the auger 24 and equipped with a pressure monitoring and adjustment assembly 32.

In more detail, the auger 24 (see FIGS. 2–5) includes an elongated central shaft 34 supporting upper and lower, outwardly extending helical auger flighting sections 36, 38, as well as a lowermost end cap 40. The shaft 34 and flighting sections 36, 38 are cooperatively configured for lateral displacement and compaction of soil during rotation of the auger 24, in order to create a bore hole 22 with little or more spoil being delivered to the surface.

The shaft 34 includes an innermost, hollow, cementious material-conveying pipe 42 which extends the full length of the auger 24 and is of stepped, decreasing diameter along the lower portion thereof adjacent flighting section 38. The shaft 34 further includes a series of spiral sections 44–48 of increasing diameter in the upper portion of the auger 24, an essentially circular in cross-section, maximum diameter compaction section 50 at the central region of the auger 24, and a series of lower spiral sections 52–58 of decreasing diameter from the central section 50 towards cap 40. Each of the sections 44–58 are made up of a series of elongated, flat plates 60 (see FIGS. 2 and 5) which are welded together along their adjacent side margins to form a continuous section. Each continuous section is secured to the inner pipe 42 by means of a series of radially outwardly extending strut connectors 62 welded to the outer face of pipe 42 and the inner surface of the respective continuous section. Moreover, it will be observed that each section 44–56 is bounded at its upper and lower extremity by a portion of the adjacent flighting 36 or 38, whereas section 58 is bounded at its upper extremity by a flighting portion but has cap 40 adjacent its lower end.

Figure 2:
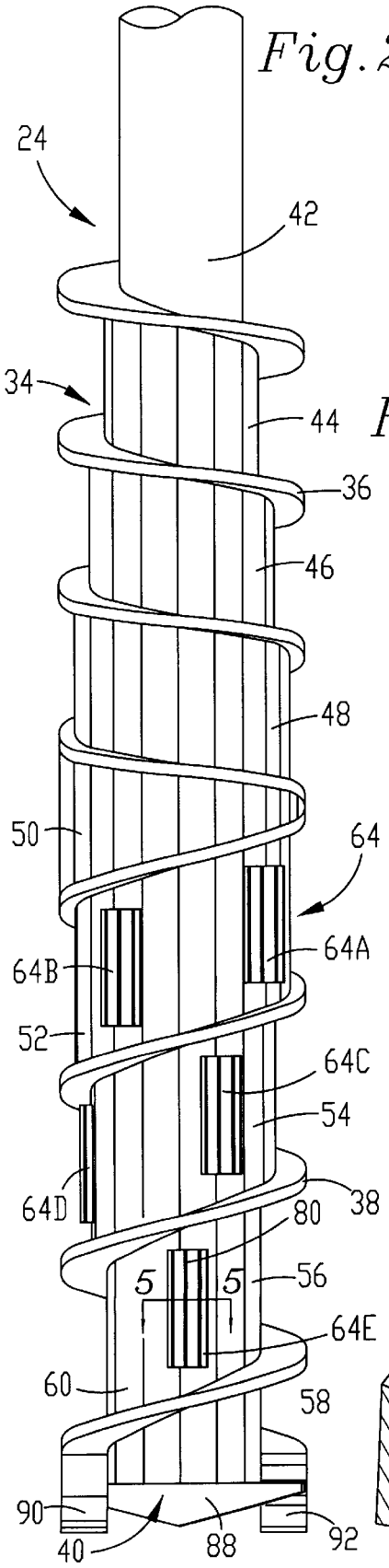
FIG. 2 is a an elevational view of the preferred lateral soil displacement and compaction auger.
Figure 5:
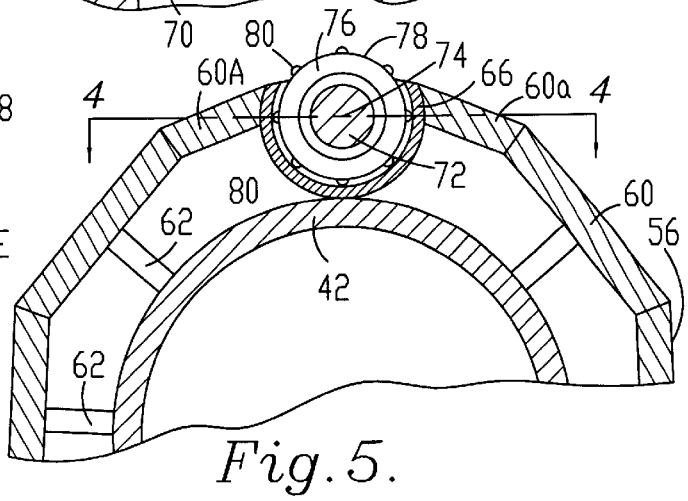
FIG. 5 is a sectional view taken along line 5—5 of FIG. 2.

The lower shaft sections 52–56 are each equipped with a series of circumferentially spaced, axially extending roller assemblies 64 labeled as rollers 64A–64E in FIG. 2. Each such roller assembly includes an elongated, axially extending, arcuate in cross-section casing or rear wall 66 with upper and lower arcuate end plates 68, 70. As best seen in FIG. 5, the side margins of casing 66 are interconnected to flat plates 60*a* forming a part of the respective section. An elongated, upright shaft 72 is secured to and extends between end plates 68, 70 and supports a tubular synthetic resin bearing member 74. A metallic roller 76 is rotatably supported on bearing member 74 and presents an outer periphery 78. In addition, each roller 76 is equipped with a series of elongated, axially extending, circumferentially spaced and outwardly extending ribs 80. As best seen in FIG. 5, the roller 76 is dimensioned with respect to casing 66 so as to provide a very small clearance between the roller periphery 78 and ribs 80, and the outer surface of the casing. It will also be seen that the respective roller assemblies 64 are axially staggered along the length of the auger 24.

Figure 3:
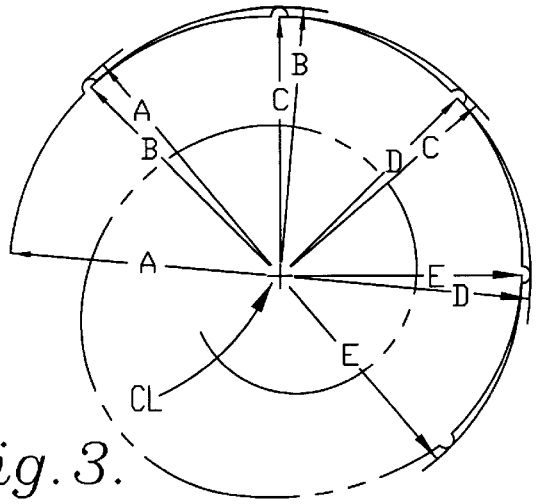
FIG. 3 is a schematic dimensional representation illustrating the decreasing diameter of the auger shaft from the maximum diameter central region towards the lower auger tip.
Figure 4:
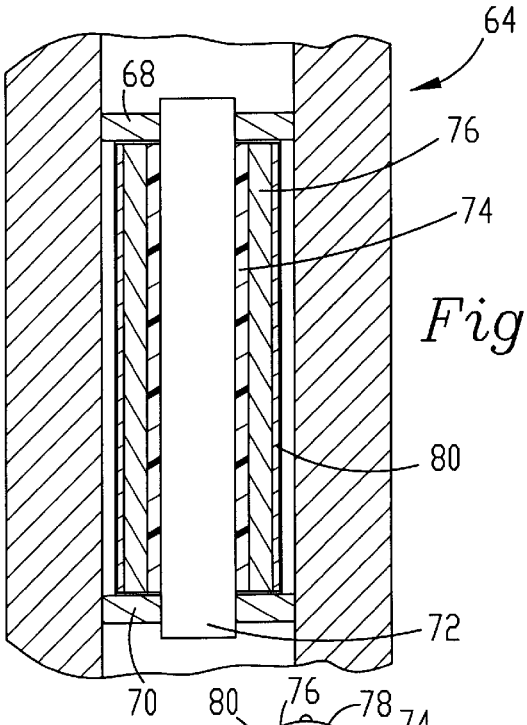
FIG. 4 is a fragmentary vertical sectional view illustrating the construction and mounting of one of the auger shaft roller assemblies.

Referring specifically to FIG. 3, it will be seen that the outer periphery of lowermost roller 64E is oriented at a radial distance E from the centerline CL of auger 34. Likewise, each of the rollers 64D, 64C, 64B and 64A are located so that their respective peripheries are at increasing radial distances D, C, B and A from the centerline CL, so that the roller peripheries cooperatively define an expanding spiral surface. The corresponding expanding spiral surface of the bore hole 22 trails just behind the peripheries of the rollers 64E–64A in order to keep earth from falling behind the outer peripheries of the roller. The largest radial distance A corresponds with the radius of central section 50 of the auger 24. In this fashion, as the auger 24 is rotated, the respective rollers successively laterally displace and compact the earth in a progressive fashion owing to the increasing radial distances E–A between centerline CL and the roller peripheries, until center section 50 is reached. Accordingly, the rollers 64A–64E are primarily responsible for the lateral displacement and compaction of soil, rather than central section 50. This reduces frictional forces during bore hole formation.

Figure 6:
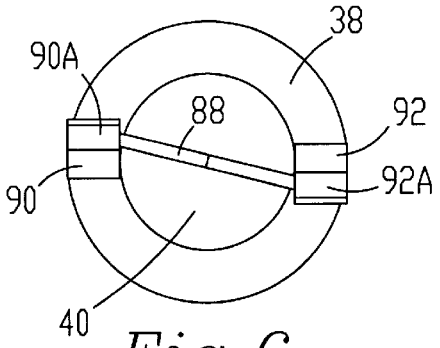
FIG. 6 is a bottom view of the preferred lateral displacement and compaction auger and depicting the coupling of the auger tip.

End cap 40 (see FIGS. 2 and 6–7) includes an upper mounting plate 82 having a pair of upstanding cross plates 84, 86 secured to the upper surface thereof. As shown, the plates 84, 86 are sized so that they are slidably received within the lower open end of pipe 42. The mounting plate 82 also includes a depending, pointed tip member 88 the ends of which extend outwardly beyond the plate 82. The cap 40 is maintained in driving engagement with auger 24 by means of a pair of depending ears or teeth 90, 92 coupled to auger flighting 38 and having obliquely oriented lowermost segments 90*a*, 92*a*. As best seen in FIG. 2, the projecting ends of tip member 88 are received within the confines of the teeth 90, 92 during rotation of the auger 24. However, the cap 40 is axially shiftable within pipe 42 to a limited degree so as to permit passage of cementious material passed the tip as exemplified by arrows 94. In order to assist in retention of the tip 40 during withdrawal of auger 24 from bore hole 40 during filling of the latter, a pair of chains 96, 98 are provided. As shown, the chains 96, 98 are connected to the inner surface of pipe 42 and to plate 84. It will also be observed that the teeth 90, 92 (which are shown in broken away relationship in FIG. 7) are sized to accommodate downward shifting of the cap 40 while retaining the aforementioned driving connection.

The cage 26 is entirely conventional and is adapted to rest upon the upper surface of the earth adjacent bore hole 22. As those skilled in the art will readily appreciate, the cage 26 is adapted to support auger 24 during vertical movement thereof, and also supports drive unit 100 serving to rotate the auger 24.

Cementious material pump 30 is a mobile unit adapted to be coupled to a supply of cementious material (not shown). The pump 30 includes a cementious material delivery line 102 as well as a return line 104. The lines 102, 104 are coupled to the upper end of pipe 42 by means of a somewhat Y-shaped, bifurcated cementious material cap 106 (FIG. 1). As shown, the delivery line 102 is connected to one of the cap bifurcations, whereas the return line 104 is connected to the other bifurcation.

Figure 8:
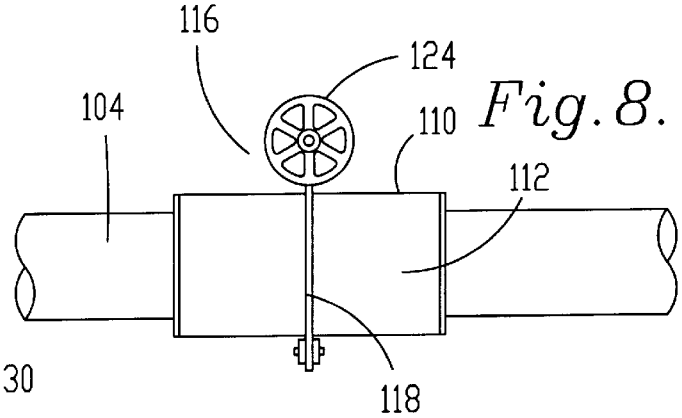
FIG. 8 is a fragmentary view depicting the preferred throttle valve assembly operatively coupled to the cementious material return line of the overall assembly.
Figure 9:
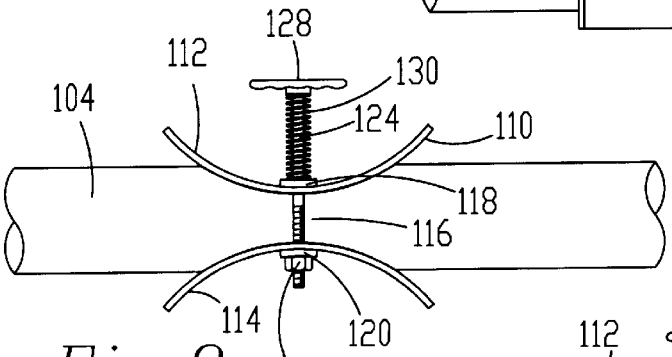
FIG. 9 is a side view of the throttle valve assembly.
Figure 10:
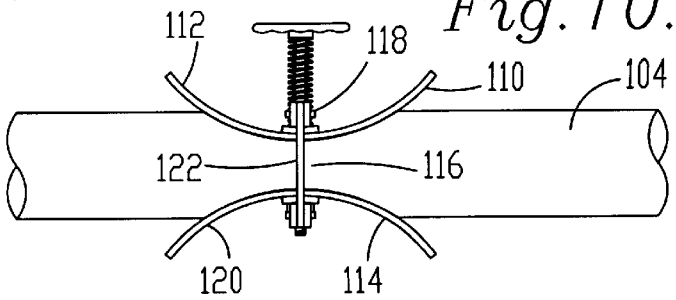
FIG. 10 is another side view of the throttle valve assembly.

The assembly 32 is designed to monitor pressure within return line 104 and thereby the pressure within bore hole 22 during filling operations. In particular, the assembly 32 includes a pressure gauge 108 provided with a readout dial, as well as a throttle valve 110 serving to adjust pressure within the line 104. The valve 110 includes upper and lower, opposed, spaced apart, arcuate throttle plates 112, 114 which engage line 104 as best seen in FIGS. 8–10. The throttle plates 112, 114 are interconnected by means of an adjustable screw 116 assembly. The screw assembly 116 includes a pair of elongated, transversely extending, throttle plate-engaging arms 118, 120 each pivotally coupled to an upright connector pin 122. The opposite ends of the arms 118, 120 are coupled to an adjustable screw 124. The screw 124 is threaded into a lower nut 126 on the underside of arm 120, and has a rotatable handle 128. A coil spring 130 is positioned between handle 128 and arm 118 as shown.

In the use of assembly 20, the crane 28 is used to position cage 26 and auger bit 24 in a location desired for a bore hole 22. The drive unit 100 is then actuated to axially rotate the auger in a clockwise direction as viewed in FIG. 5 so as to begin the formation of the bore hole 22. During such rotation of the auger 24 and downward travel thereof, soil is continually laterally displaced and compacted by the action of the rollers 64E–64A described above, so that little or no spoil is delivered to grade. Moreover, the expanding spiral geometry of the rollers 64E–64A lowers frictional forces and assures even, rapid bore hole formation. The upper section of the auger 24 above central section 50 has decreasing diameter sections 44–48 as shown, in order to further prevent undue pressure buildup.

Figure 7:
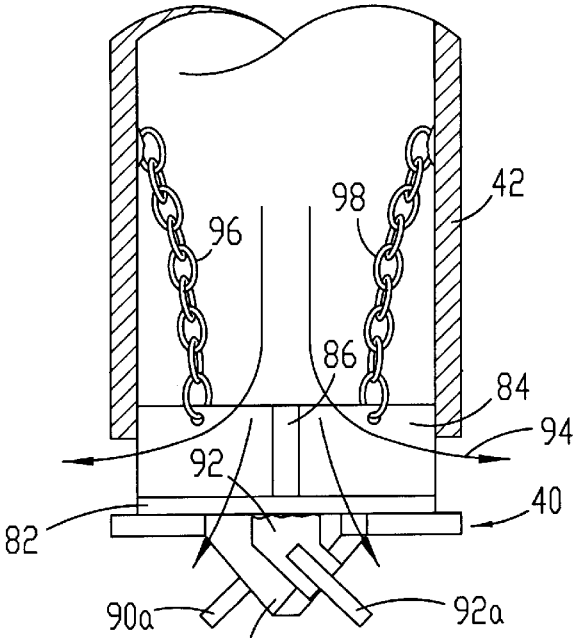
FIG. 7 is a fragmentary, sectional view illustrating the auger tip retainer structure with the outboard retainer teeth in broken away relation and further illustrating the internal retention chains.

After the bore hole is created to the desired depth, the cementious material pump 30 is actuated in order to deliver cementious material through line 102 and into pipe 42 of auger 24, with continued rotation of the auger in the same direction. During cementious material delivery, the end cap 40 is shifted downwardly within pipe 42 as shown in FIG. 7 so that the cementious material may be ejected through the lower end of the pipe 42 in order to fill bore hole 22. However, owing to the presence of the retaining teeth 90, 92 and chains 96, 98, the cap 40 is not lost and is retrieved with the remainder of auger 24 as the latter is withdrawn from the bore hole 22.

During cementious material fill operations, the pressure gauge 108 is observed and in the event of undue pressure buildup within line 104 indicative of an undesirable pressure buildup within the bore hole (which can lead to premature setting of the cementious material and loss of the bit 24), the throttle valve 110 can be manipulated in order to relieve system pressure. Furthermore, in the event that there is insufficient system pressure, the throttle valve 110 can be tightened for this purpose.

Turning now to FIGS. 11 and 12, another embodiment of the invention is shown in the form of augers 132, 134 each including an upper lateral soil displacement and compaction portion 136 together with elongated drilling extension 138. Referring first to FIG. 11, the auger 132 includes an elongated central shaft 140 supporting outwardly extending auger flighting 142 thereon. Although not shown in detail, the shaft 140 includes an innermost, hollow, cementious material-conveying pipe extending the full length of the auger for delivery of cementious material through an aperture (not shown in FIG. 11) at the lower end of the drilling extension 138.

The upper compaction portion 136 is substantially identical with auger 24 and includes a series of spiral sections such as sections 144, 146 of increasing diameter, an essentially circular in cross-section, maximum diameter compaction section 148, and a series of lower spiral sections 150, 152, 154 of decreasing diameter from the central section 148. The sections 144–154 can be made up of a series of elongated, welded-together flat plates as discussed with reference to auger 24, or can be formed from continuous metallic segments.

The lower shaft sections 150–154 are each equipped with a series of circumferentially spaced, axially extending roller assemblies 156; these roller assemblies 156 and their associated mounting structure is preferably the same as that described with reference to auger 24 and particularly illustrated in FIGS. 2–5; accordingly, a detailed discussion of this structure is not repeated.

The drilling extension 138 depends from the compaction portion 136 and includes a substantially constant diameter shaft portion 158 together with flighting 160 which is preferably though not necessarily of constant pitch. The lower end of the shaft section 158 supports a conventional cutting head 162 which may assume a variety of configurations, depending upon the type of soil to be encountered.

The auger 132 can be formed as a unitary structure. Alternately, a detachable coupler may be provided at the lower end of the compaction section 136, so that drilling extension 138 of varying length may be secured thereto. Likewise, the cutting heads may be detachably coupled with the lower end of the drilling extension, thus providing an additional degree of operational flexibility.

The purpose of drilling extension 138 is to facilitate bore hole formation in soils which may have relatively loose, compactible zones closer to the surface, but harder, more dense sections therebelow. With the auger 132, a bore hole of adequate length can be formed while providing lateral compaction only in the soil region susceptible to such treatment. To this end, it is preferred that the drilling extension 138 have a length atleast 50% of the length of the compaction portion, and more preferably a length at least equal to the compaction portion.

FIG. 12 illustrates another auger 134 having an upper compaction portion and a lower drilling extension. As shown in FIG. 12, the lower end of the drilling extension has a cementious material aperture 164 therethrough, and also has a differently configured cutting head 166. The remainder of the auger 134, apart from these noted features, is identical with auger 132.

The use of augers 132, 134 closely parallels that of auger 24. Thus, a crane is used to position a supporting cage and the auger in a location for a desired bore hole. The auger is then axially rotated to begin formation of the bore hole. During such rotation and downward travel of the auger, soil is displaced upwardly by the action of the drilling extension 138 until the compaction portion 136 is encountered whereupon this soil is laterally compacted in the region of the compaction portion, owing to the action of the rollers 156 and the configuration of the compaction portion. After the bore hole is created to a desired depth, the cementious material pump is actuated with continued rotation of the auger. Cementious material is delivered through the auger shaft and passes through an auger aperture, such as the aperture 164 illustrated in FIG. 12. Normally, this aperture is closed by any convenient type of plug, with the plug being displaced under the influence of cementious material pressure to allow flow of cementious material from the auger shaft.

Figures 13, 14:
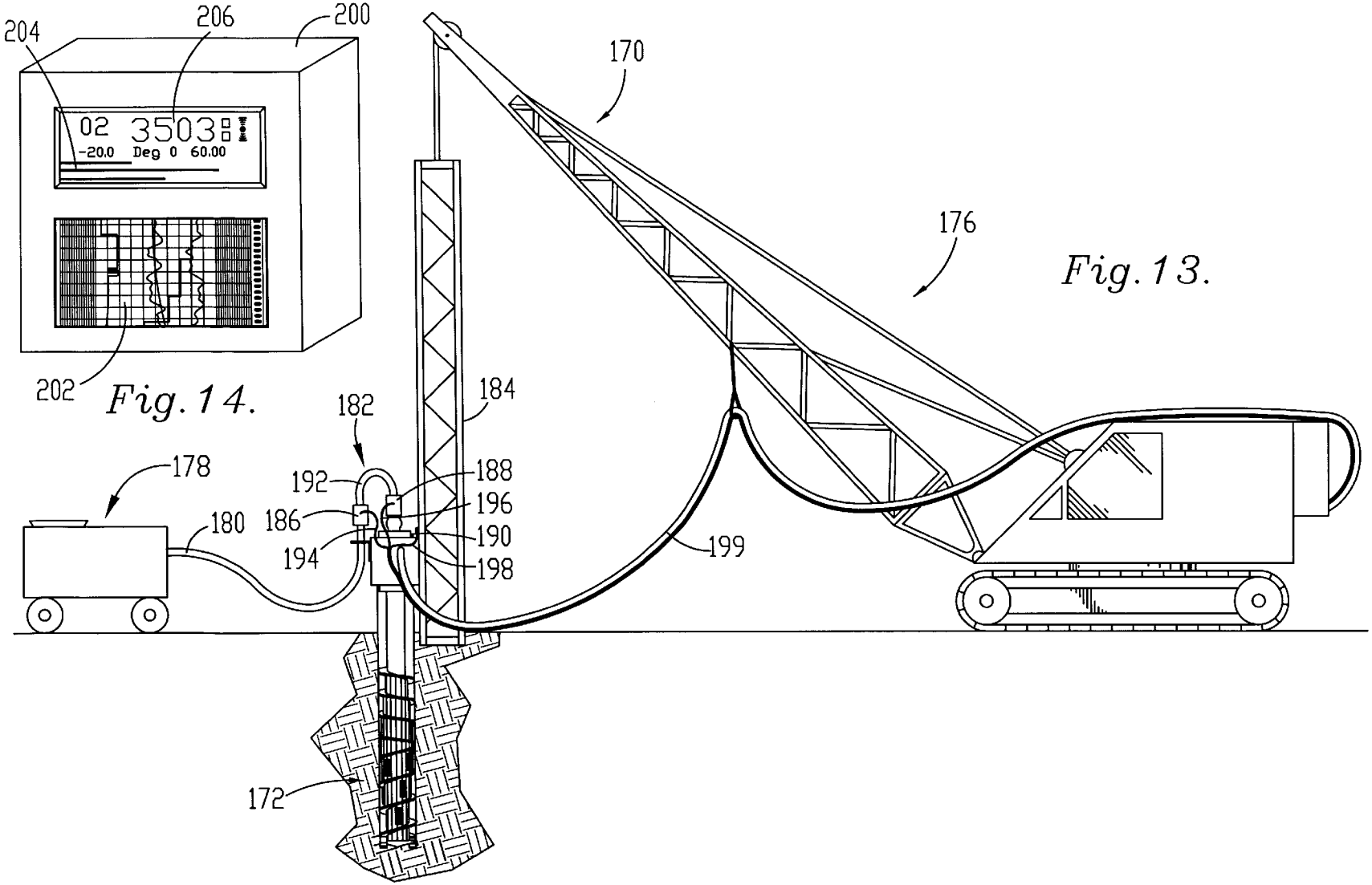
FIG. 13 is a schematic view similar to that of FIG. 1 but illustrating an auger in accordance with the invention equipped with cementious material flow and pressure sensors in series with the cementious material delivery line, as well as a drill depth sensor.
FIG. 14 is an enlarged perspective view depicting a preferred recorder for all of the sensors of the FIG. 13 embodiment.

FIG. 13 illustrates the use of a compaction auger assembly 170 very similar to that illustrate in FIG. 1 and including a lateral compaction auger bit 172 supported on an upright cage 174, the latter held in place via mobile crane 176. The overall assembly 170 also has a cementious material pump 178 operatively coupled to the auger 172 via a cementious material delivery line 180.

The auger 172 is identical with auger 24 previously described, except for the provision of a control and monitoring assembly 182 mounted atop the drive unit 184 for the auger. In particular, the assembly 182 includes a cementious material flow sensor 186, a cementious material pressure sensor 188, and a drill depth sensor 190. As shown, the sensors 186, 188 are mounted in series with line 180 and are interconnected by a short, somewhat U-shaped cementious material conveying line 192. On the other hand, sensor 190 includes a roller which engages cage 174 so as to monitor the depth of auger 172 during rotation thereof.

Each of the sensors 186–190 has an output lead 194, 196, 198 which extend from the assembly 182 and are bundled within a conduit 199 and extend to the cab of crane 176. The leads are connected within the cab to a readout device 200. The preferred device 200 has a chart-type recording output 202 and a constant bar graph output 204 for all of the sensors 186–190 combined. In addition, a digital output 206 is provided which gives alternate readings for cementious material pressure, cementious material flow or depth. In an alternative embodiment, a remote, portable readout device (not shown) can be used which receives input data via radio.

The sensors 186–190 and readout device 200 are commercially available. Thus, the presently preferred pressure sensor is an Ashcroft K1 pressure transmitter; the preferred flow sensor is a Model 626 Sparling flow meter; and the sensor 190 is a Model LSC single channel output length sensor sold by Red Lion Controls. The readout device 200 is a Model 4100 recorder sold by Eurotherm Chessell.

The use of the cementious material pressure sensor 188 gives the operator within the crane cab real time information on pressure of cementious material at the auger. The operator in turn can control this pressure by adjusting the rate of auger removal while pumping cementious material to the bore hole. The cementious material flow sensor 186 gives information pertaining to the quantity of cementious material delivered per foot of bore hole depth, per pile and total per day. The drill depth sensor 190 gives the operator exact depth readings of the auger. By combining all three sources of this information, the user can generate an accurate record of how the pile was formed over its entire depth and also more accurately control pile formation.

For example, it will be understood that after the bore hole is formed and cementious material is delivered to fill the entire auger stem, the pressure sensor 188 is pressurized and this information is delivered via the lead 194 to the readout device 200. The pressure desired can be initially attained by holding the auger in place within the bore hole or by adjusting the rate of removal of the auger from the bore hole. Thus, by predetermining the optimum pressure desired to form a pile, the crane operator can maintain that pressure by controlling the removal rate of the auger from the bore hole during filling. This leads to a more uniform and predictable pile formation.

I claim:

1. A lateral compaction auger used in the formation of bore holes adapted to receive cementious material for the formation of piles and comprising:

an elongated central shaft presenting a lower end;

outwardly extending helical auger flighting supported on said shaft, said shaft and flighting being cooperatively configured for lateral displacement and compaction of soil during rotation of the auger;

a plurality of elongated rollers each presenting an outer periphery; and means rotatably mounting each of said rollers between respective flight sections of said auger flighting, including an elongated, arcuate in cross-section casing member operatively coupled with said shaft and complemental with a corresponding roller received therein, the clearance between each roller periphery and the adjacent casing being sufficiently small to prevent undue buildup of earth on the roller during use of the auger.

2. The auger of claim 1, each of said rollers including a plurality of elongated, circumferentially spaced, outwardly projecting ribs on the periphery thereof.

3. The auger of claim 1, the ends of each of said rollers being axially spaced from the adjacent flight sections.

4. The auger of claim 1, said central shaft presenting a central region of maximum diameter which defines the diameter of a bore hole created by the auger, said shaft being of decreasing diameter from said central region towards the auger lower end.

5. The auger of claim 1, said central shaft including an innermost, hollow, cementious material-conveying pipe.

6. The auger of claim 1, including a tip member adjacent said lower auger end, there being teeth elements coupled to said central shaft and operably engaging said tip member during rotation of the auger.

7. The auger of claim 6, said central shaft including an innermost, hollow, cementious material-conveying pipe, said auger including means operatively connecting said tip to said central shaft and permitting limited axial displacement of the tip relative to the pipe for passage of cementious material from said pipe into said bore hole.

8. The auger of claim 7, said tip connecting means including a plurality of flexible chains.

9. An auger used in the formation of bore holes adapted to receive cementious material for the formation of piles and comprising:

an elongated central shaft presenting an innermost, hollow, cementious material-conveying pipe, a lower end, and a pair of depending teeth elements adjacent the lower end;

outwardly extending helical auger flighting supported on said shaft;

a tip member adjacent said auger lower end, said tip member operably engaging said teeth elements during rotation of the auger; and means operatively connecting said tip to said central shaft and permitting limited axial displacement of the tip relative to the pipe for passage of cementious material from said pipe into said bore hole.

10. The auger of claim 9, said tip connecting means including a plurality of flexible chains.

11. The auger of claim 9, said auger being a lateral compaction auger, said shaft and flighting being cooperatively configured for lateral displacement and compaction of soil during rotation of the auger.

12. A lateral compaction auger assembly used in the formation of bore holes adapted to receive cementious material for the formation of piles and comprising:

a lateral compaction auger including an elongated central shaft presenting a hollow cementious material-conveying pipe and a lower end;

outwardly extending helical auger flighting supported on said shaft, said shaft and flighting being cooperatively configured for lateral displacement and compaction of soil during rotation of the auger;

means for supplying cementious material to said pipe including a cementious material pump and a supply line leading from the pump to said pipe;

a cementious material return line separate from said supply line and operatively coupled between said pipe and cementious material pump;

means for determining the pressure within said cementious material return line; and means for selectively adjusting said pressure.

13. The assembly of claim 12, said pressure adjusting means comprising a selectively adjustable throttle valve operatively coupled to said cementious material return line.

14. The assembly of claim 12, said pressure-determining means comprising a pressure gauge.

15. The assembly of claim 12, including a hollow, bifurcated cementious material cap operatively coupled to said pipe, said supply line being secured to one of the cap bifurcations, said route return line being operatively coupled to the other of said bifurcations.

16. An auger assembly used in the formation of bore holes adapted to receive cementious material for the formation of piles and comprising:

an auger including an elongated central shaft presenting a hollow cementious material-conveying pipe with outwardly extending auger flighting supported on said shaft;

a cementious material pump and a supply line leading from the pump to said pipe for supplying cementious material to the pipe;

a cementious material return line separate from said supply line and operatively coupled between said pipe and cementious material pump;

means for determining the pressure within said cementious material return line; and a pressure adjusting mechanism operatively coupled with said cementious material return line.

17. The auger assembly of claim 16, said auger being a lateral compaction auger.

18. A lateral compaction auger used in the formation of bore holes adapted to receive cementitious material for the formation of piles and comprising:

an elongated central shaft presenting a lower end;

outwardly extending helical auger flighting supported on said shaft, at least a portion of said shaft and flighting being cooperatively configured for lateral displacement and compaction of soil during rotation of the auger, said auger including an elongated drilling extension below said lateral compaction portion, said extension having a length at least about 50% of the length of said lateral compaction portion; and a cutting lead supported on the end of said extension below said lateral compaction portion, said central shaft having an innermost, hollow, cementitious material-conveying pipe extending the full length thereof through said lateral compaction portion and said extension, there being a cementitious material opening adjacent the lower end of said extension.

19. The auger of claim 18, said extension having a length at least equal to said length of said lateral compaction portion.

20. The auger of claim 18, said lateral compaction portion and said drilling extension being formed as an integral body.

21. An auger assembly used in the formation of bore holes adapted to receive cementious material for the formation of piles and comprising:

an auger including an elongated central shaft presenting a hollow cementious material-conveying pipe with outwardly extending auger flighting supported on said shaft;

a cementious material pump and a supply line leading from the pump to said pipe for supplying cementious material to the pipe; and a cementious material flow sensor and a cementious material pressure sensor mounted in series with said supply line for monitoring cementious material flow and pressure delivered to said auger.

22. The assembly of claim 21, said cementious material flow sensor being mounted upstream of said cementious material pressure sensor.

23. The assembly of claim 21, including an auger depth sensor operatively coupled with said auger for sensing the depth thereof.

24. The assembly of claim 23, including a readout device, and means operatively coupling the cementious material flow sensor, cementious material pressure sensor and said depth sensor with the readout device.

* * * * *